US008342823B2

(12) United States Patent
Kim et al.

(10) Patent No.: US 8,342,823 B2
(45) Date of Patent: Jan. 1, 2013

(54) SLUDGE SUCTION APPARATUS FOR OFFSHORE STRUCTURE

(75) Inventors: Young-Ju Kim, Daejeon (KR); Deok Hwan Kim, Hanam-si (KR); So Keul Chung, Daejeon (KR); Nam-Sub Woo, Daejeon (KR)

(73) Assignee: Korea Institute of Geoscience and Mineral Resources, Daejeon (KR)

( * ) Notice: Subject to any disclaimer, the term of this patent is extended or adjusted under 35 U.S.C. 154(b) by 249 days.

(21) Appl. No.: 12/838,900

(22) Filed: Jul. 19, 2010

(65) Prior Publication Data

US 2011/0206547 A1 Aug. 25, 2011

(30) Foreign Application Priority Data

Feb. 24, 2010 (KR) ..... 10-2010-0016585

(51) Int. Cl.
*F04B 53/00* (2006.01)

(52) U.S. Cl. .... 417/458; 417/456; 417/568; 137/543.21

(58) Field of Classification Search ..... 417/456, 417/458, 568; 137/453.21
See application file for complete search history.

(56) References Cited

U.S. PATENT DOCUMENTS 4,687,421 A * 8/1987 Cameron et al. ..... 417/296

* cited by examiner

*Primary Examiner* — Charles Freay
*Assistant Examiner* — Patrick Hamo
(74) *Attorney, Agent, or Firm* — Kile Park Goekjian Reed & McManus PLLC

(57) ABSTRACT

Disclosed is a sludge suction apparatus for an offshore structure. The sludge suction apparatus includes a housing having an upper mounting hole and a lower mounting hole; a suction valve installed in the lower mounting hole in line with a suction hole to selectively suck sludge according to variation of internal pressure of the housing; an exhaust valve installed in the upper mounting hole to communicate with the exhaust hole and aligned coaxially with the suction valve to exhaust the sludge to an outside through the exhaust hole;

a valve port coupled to an upper portion of the upper mounting hole and formed with a fixing groove coupled with an upper portion of the exhaust valve; and a piston assembly fixedly coupled with the coupling section and reciprocated in forward and rearward directions to operate the suction valve and the exhaust valve.

3 Claims, 7 Drawing Sheets

- Prior Art -

SLUDGE SUCTION APPARATUS FOR OFFSHORE STRUCTURE

BACKGROUND OF THE INVENTION

1.Field of the Invention

The present invention relates to a sludge suction apparatus for an offshore structure. More particularly, the present invention relates to a sludge suction apparatus for an offshore structure, in which the sludge suction apparatus has no suction valve fixing unit, so that the manufacturing cost thereof can be reduced, and the sludge suction apparatus is easily assembled and disassembled so that stability and workability can be improved and operation efficiency thereof can be enhanced.

2. Description of the Related Art

In general, a sludge suction apparatus for an offshore structure is used in the chemical industrial field, the construction industrial field and the offshore plant field to supply a great amount of sludge or mud under high pressure for a long period of time. The sludge suction apparatus is very expensive, so the maintenance and repair work must be frequently performed with respect to the sludge suction apparatus. Recently, various apparatuses and methods have been developed in order to improve productivity in the industrial field while reducing assembling and disassembling time in the repair work.

FIG. 1 is a sectional view showing a sludge suction apparatus for an offshore structure according to the related art.

As shown in FIG. 1, the conventional sludge suction apparatus includes a valve body 110 having a suction hole 114 for receiving sludge and an exhaust hole 112 for exhausting the sludge, a suction valve 120 installed in the valve body 110 coaxially with the suction hole 114 to suck the sludge, and a piston assembly 170 for operating the suction valve 120 and an exhaust valve 130 through the reciprocation movement of a piston 172.

In addition, the conventional sludge suction apparatus includes a cage 122 installed in the valve body 110 to fix the suction valve 120 and the exhaust valve 130, which exhausts the sludge sucked by the suction valve 120 to the outside, a yoke 140 for supporting one end of the cage 122 to completely close an installation hole 116 formed at one side of the valve body 110 to install the suction valve 120, a yoke fixing member 150 for supporting the yoke 140 to prevent the yoke 140 from being pushed rearward due to variation of internal pressure of the valve body 110, and a fixing ring 160 for fixing the yoke fixing member 150 to the valve body 110 while preventing leakage of internal pressure of the valve body 110.

According to the conventional sludge suction apparatus having the above structure, the installation hole 116 must be formed at one side of the valve body 110 in order to install the suction valve 120 and the cage 122, which supports an upper end of the suction valve 120, in the valve body 110. In addition, the yoke 140, the yoke fixing member 150 and the fixing ring 160 must be provided to prevent the leakage of internal pressure of the valve body 110 by sealing the installation hole 116 when the suction valve 120 and the cage 122 have been installed. Thus, the manufacturing cost for the conventional sludge suction apparatus is increased and the assembling and disassembling time is increased.

In addition, as time goes by, the yoke 140 inserted into the installation hole 116 is worn or corroded, so the internal pressure of the valve body 110 leaked and supporting force of the cage 122 is weakened, thereby significantly degrading the suction efficiency for the sludge.

Further, if the internal pressure of the valve body 110 is lowered below critical pressure due to pressure leakage, the sludge suction apparatus may not be used for a long period of time and the suction valve 120 and the exhaust valve 130 may malfunction, so that the cost to maintain and repair the sludge suction apparatus may be increased.

SUMMARY OF THE INVENTION

Accordingly, the present invention has been made keeping in mind the above problems occurring in the prior art, and an object of the present invention is to provide a sludge suction apparatus for an offshore structure, in which the sludge suction apparatus has no suction valve fixing unit, so that the manufacturing cost thereof can be reduced, and the sludge suction apparatus is easily assembled and disassembled so that stability and workability can be improved.

Another object of the present invention is to provide a sludge suction apparatus for an offshore structure, in which a suction valve provided at an upper end thereof with a divergent retainer is installed in a mounting hole, in which an exhaust valve is installed, coaxially with the exhaust valve, so that the suction and exhaust operation can be realized according to the operation of a piston, even if a fixing unit, such as a yoke and a yoke fixing member for fixing the suction valve, is removed.

Still another object of the present invention is to provide a sludge suction apparatus for an offshore structure, in which pressure loss of the sludge suction apparatus is minimized when a piston operates so that pressure variation is maximized, thereby stably sucking and exhausting sludge while improving feeding force for the sludge.

To accomplish the object, according to one aspect of the present invention, there is provided a sludge suction apparatus for an offshore structure, the sludge suction apparatus comprising: a housing having an upper mounting hole communicated with an exhaust hole for exhausting sludge and a lower mounting hole communicated with a suction hole for sucking the sludge, and including a coupling section formed at one side thereof with an actuating hole communicated with the lower mounting hole; a suction valve installed in the lower mounting hole in line with the suction hole to selectively suck the sludge according to variation of internal pressure of the housing; an exhaust valve installed in the upper mounting hole to communicate with the exhaust hole and aligned coaxially with the suction valve to exhaust the sludge, which is sucked through the suction valve according to the variation of the internal pressure of the housing, to an outside through the exhaust hole; a valve port coupled to an upper portion of the upper mounting hole and formed with a fixing groove coupled with an upper portion of the exhaust valve to fix the exhaust valve; and a piston assembly fixedly coupled with the coupling section and reciprocated in forward and rearward directions to operate the suction valve and the exhaust valve by changing the internal pressure of the housing.

According to the present invention, a support step is formed between the upper mounting hole and the lower mounting hole of the housing to support the suction valve and the exhaust valve.

According to the present invention, the suction valve includes: a suction seat fixedly inserted into the lower mounting hole of the housing; a suction disc provided at an upper end thereof with a suction stem and selectively adhering to or separated from the suction seat by performing reciprocating motion in upward and downward directions according to operation of the piston assembly; a suction spring provided at an upper portion of the suction disc to return the suction disc to an initial position thereof; and a divergent retainer having an upper end fixed to the housing to support the suction spring and formed at an outer peripheral surface thereof with a sludge inlet hole to guide the sludge to the exhaust valve.

According to the present invention, the divergent retainer is provided at an upper end thereof with a fixing flange, the fixing flange fixes the suction valve to the housing, and a lower end of the exhaust valve is stably rested on the fixing flange.

According to the present invention, the exhaust valve includes: an exhaust seat fixedly inserted into the upper mounting hole of the housing; an exhaust disc provided at an upper end thereof with an exhaust stem and selectively adhering to or separated from the exhaust seat by performing reciprocating motion in upward and downward directions according to operation of the piston assembly; an exhaust spring provided at an upper portion of the exhaust disc to return the exhaust disc to an initial position thereof; an exhaust retainer supporting an upper portion of the exhaust spring and provided at an upper end thereof with a fixing section coupled with the valve port to fix the exhaust valve; and an exhaust cylinder receiving the above elements of the exhaust valve and formed with a sludge drain hole to drain the sludge to the exhaust hole.

According to the present invention, the piston assembly includes: a coupling member fixedly coupled with the coupling section of the housing; a piston housing inserted into a rear portion of the coupling member; a fixing member for fixing the piston housing to the coupling member; and an actuating cylinder installed in the piston housing and positioned in the actuating hole of the housing, the actuating cylinder including a piston and a piston rod that perform reciprocating motion in forward and rearward directions.

As described above, according to the present invention, the sludge suction apparatus has no suction valve fixing unit, so that the manufacturing cost thereof can be reduced, and the sludge suction apparatus is easily assembled and disassembled so that stability and workability can be improved.

According to the present invention, the suction valve provided at an upper end thereof with the divergent retainer is installed in the mounting hole, in which the exhaust valve is installed, coaxially with the exhaust valve, so that the sludge suction apparatus can be easily assembled and disassembled and the time for maintenance and repair work can be shortened.

According to the present invention, pressure variation in the housing is maximized during the operation of the piston, thereby stably sucking and exhausting sludge while improving feeding force for the sludge.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
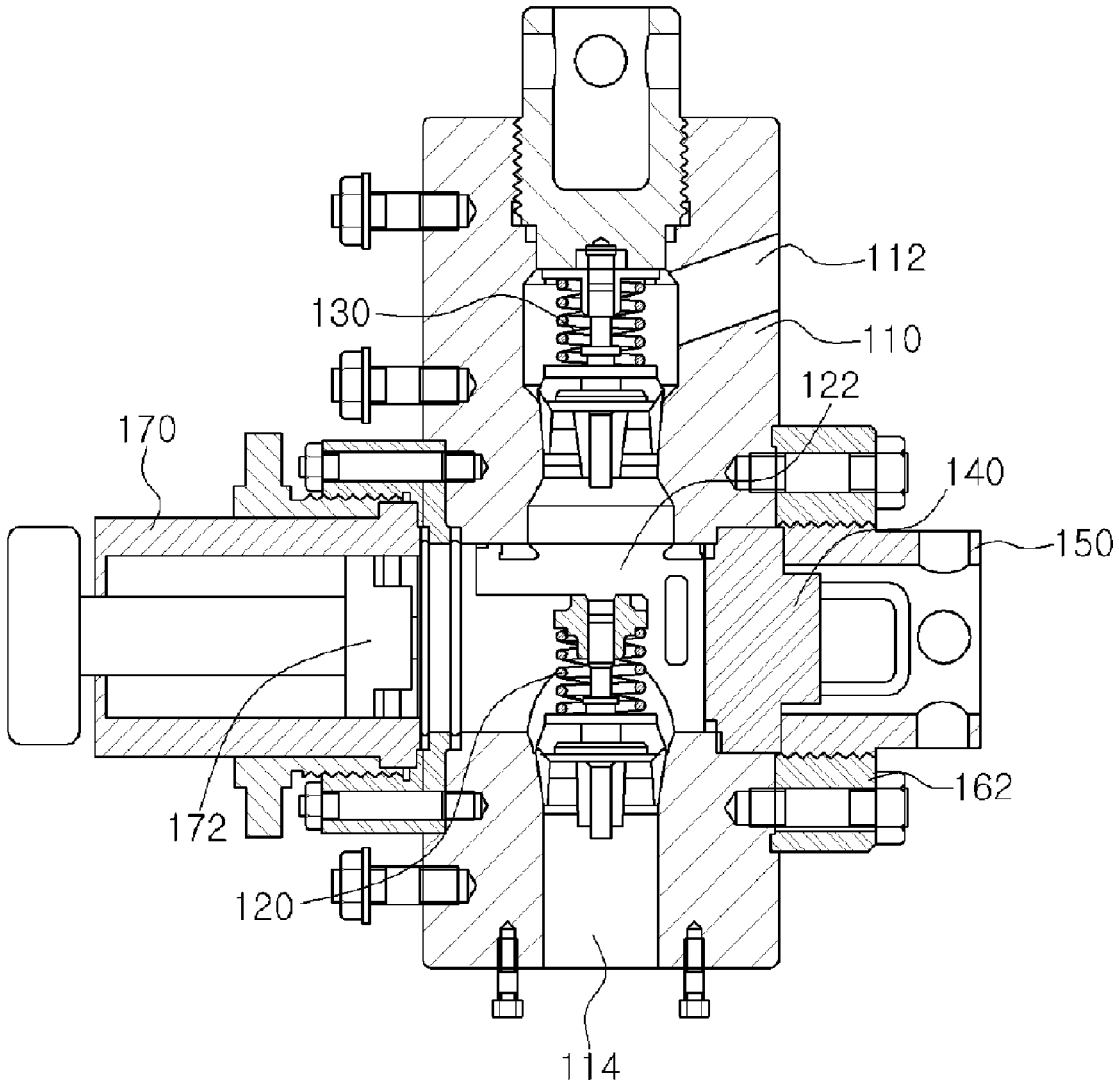
FIG. 1 is a sectional view showing a sludge suction apparatus for an offshore structure according to the related art.

Hereinafter, exemplary embodiments of the present invention will be described in detail with reference to accompanying drawings. The same reference numerals will be used to designate the same elements throughout the drawings. Detailed description about well known functions or configurations may be omitted if it makes the subject matter of the present invention unclear.

Figure 2:
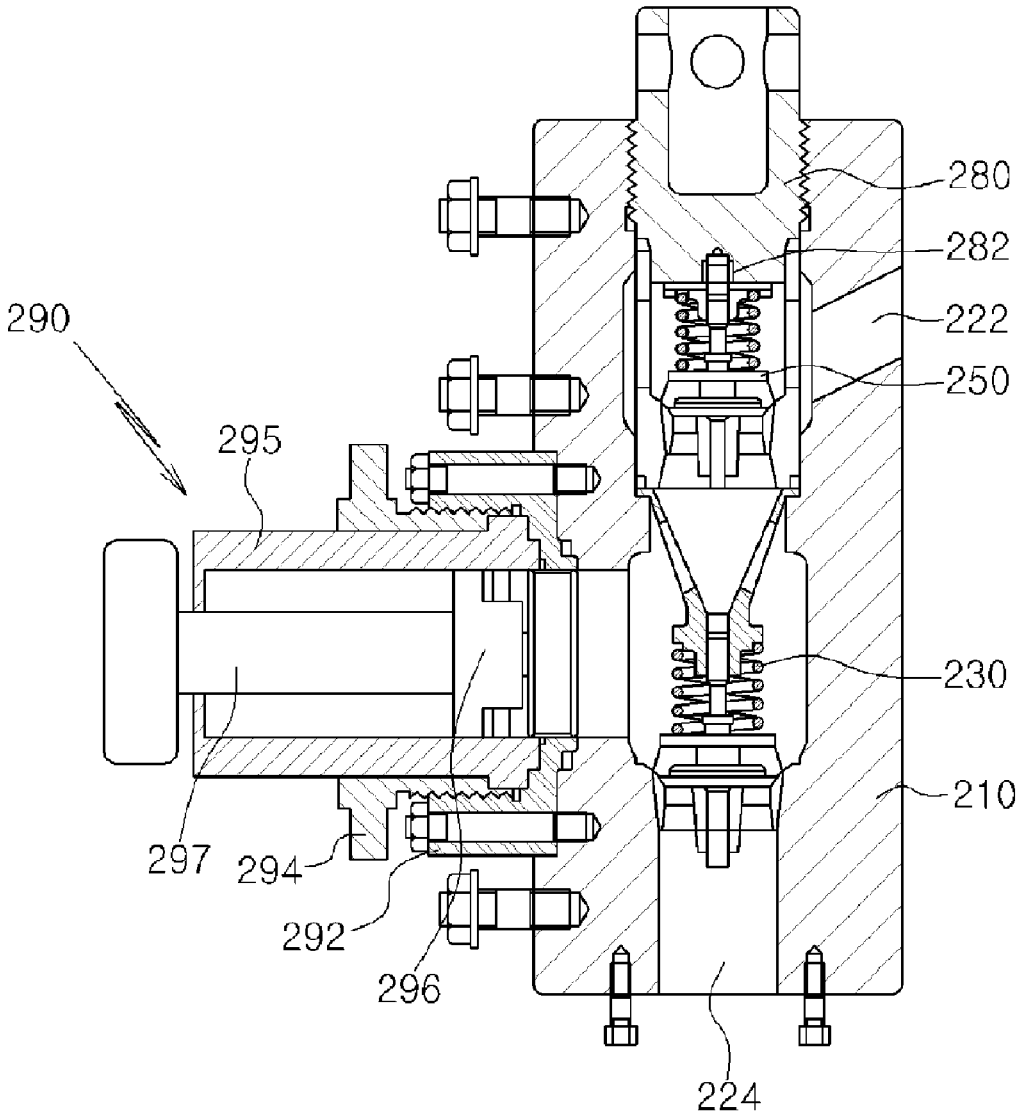
FIG. 2 is a sectional view showing a sludge suction apparatus according to the exemplary embodiment of the present invention.
Figure 3:
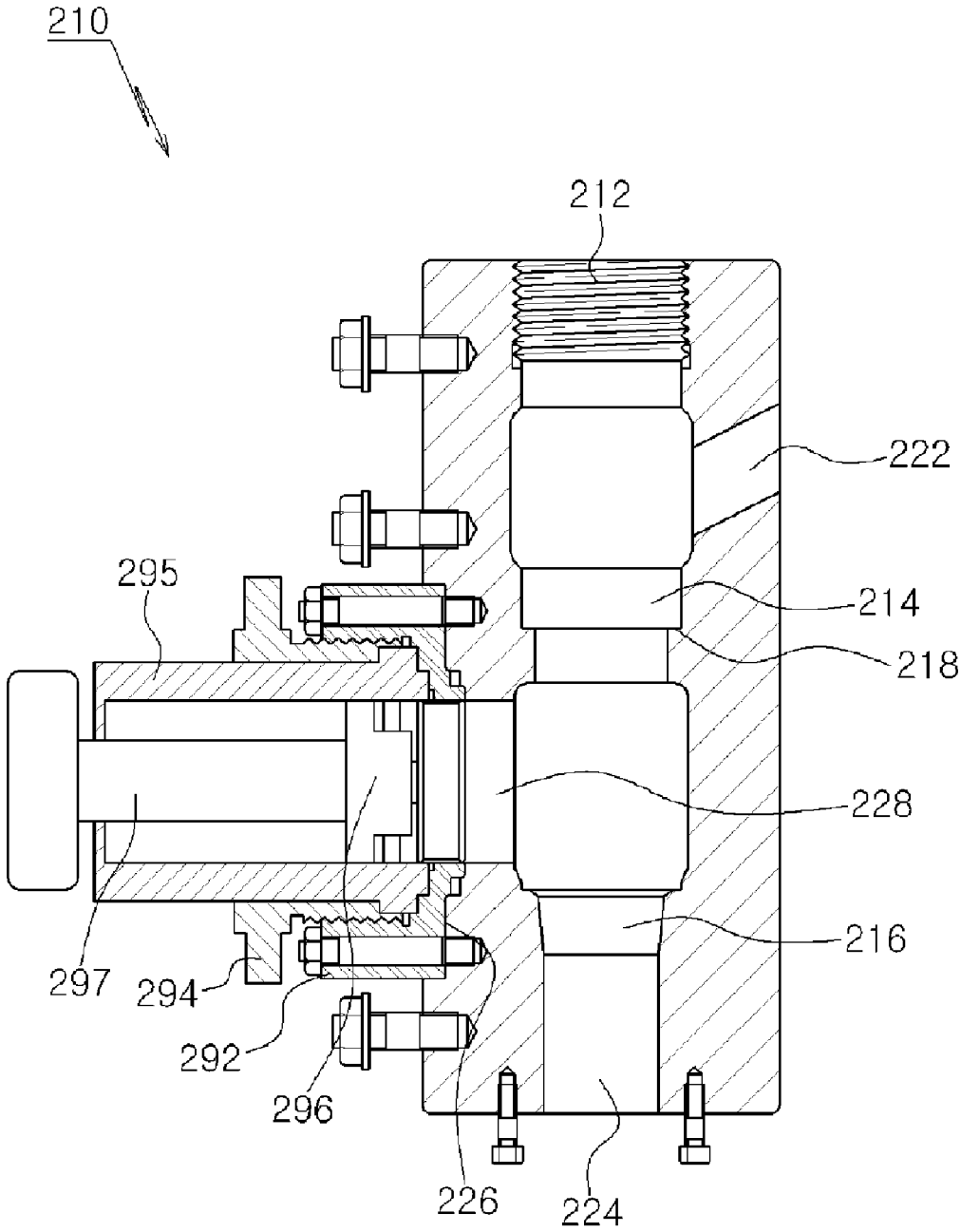
FIG. 3 is a sectional view showing a housing of a sludge suction apparatus according to the exemplary embodiment of the present invention.
Figure 4:
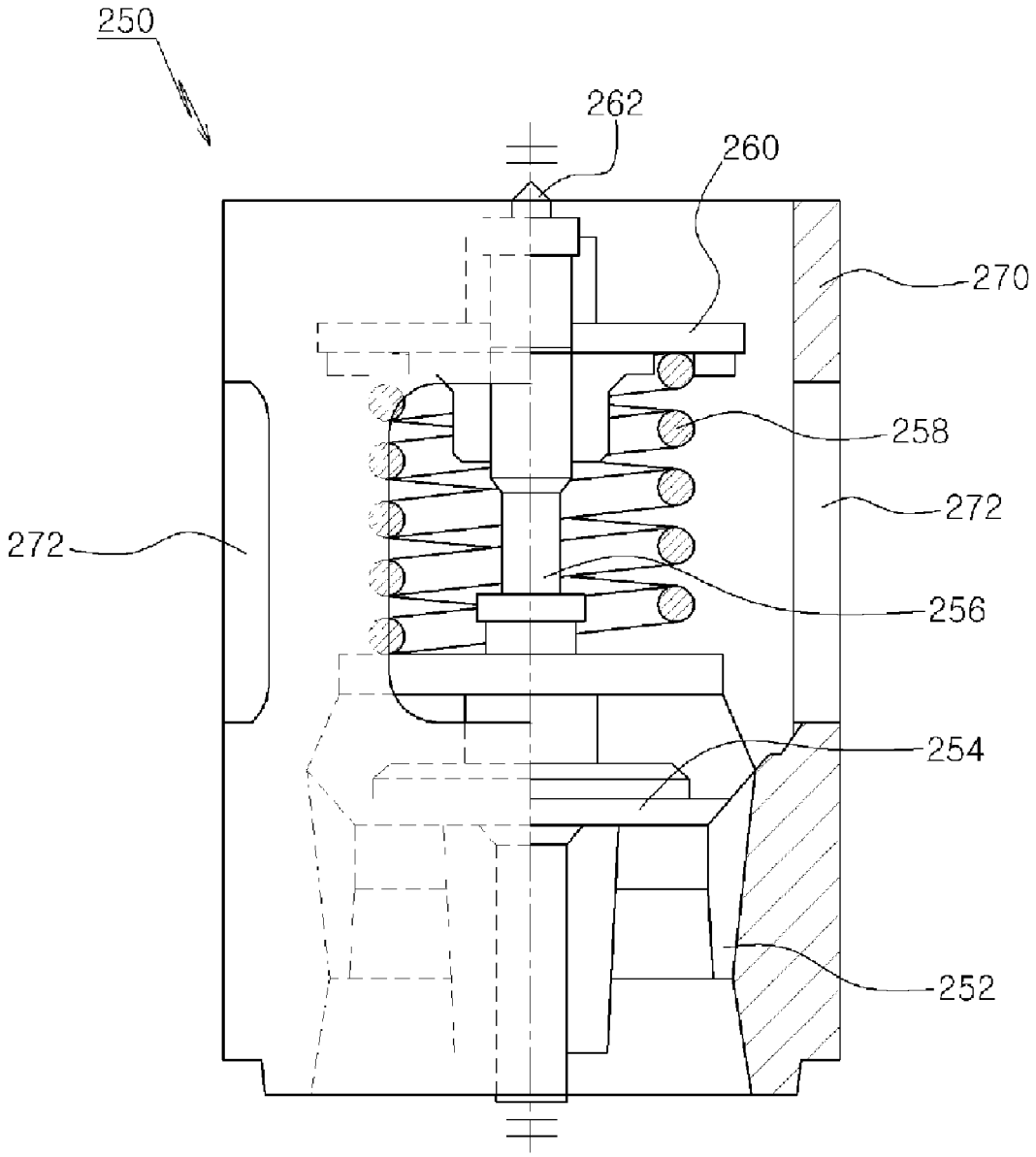
FIG. 4 is a half-sectional view showing an exhaust valve of a sludge suction apparatus according to the exemplary embodiment of the present invention.
Figure 5:
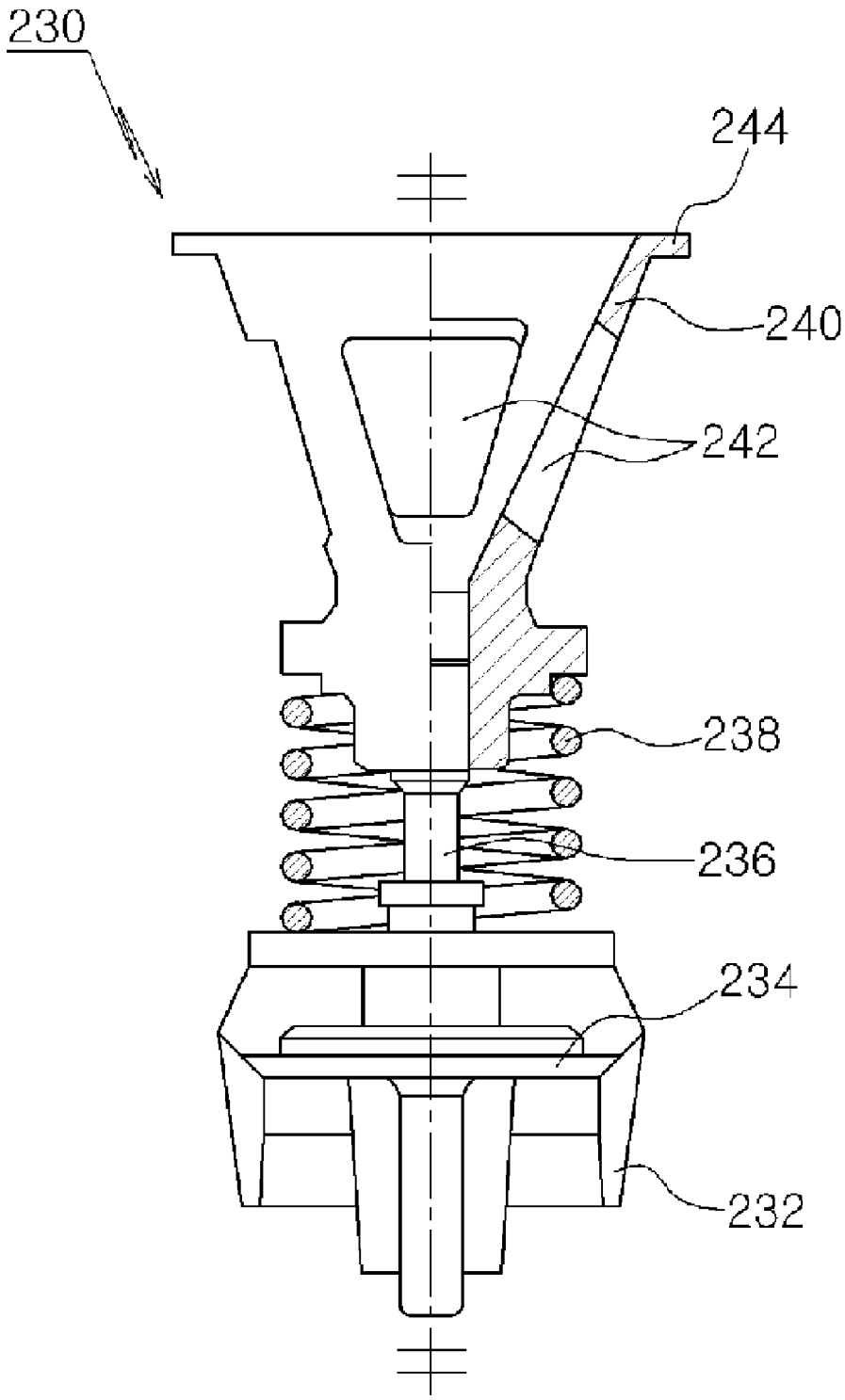
FIG. 5 is a half-sectional view showing a suction valve of a sludge suction apparatus according to the exemplary embodiment of the present invention.

FIG. 2 is a sectional view showing a sludge suction apparatus according to the exemplary embodiment of the present invention, FIG. 3 is a sectional view showing a housing of the sludge suction apparatus according to the exemplary embodiment of the present invention, FIG. 4 is a half-sectional view showing an exhaust valve of the sludge suction apparatus according to the exemplary embodiment of the present invention, and FIG. 5 is a half-sectional view showing a suction valve of the sludge suction apparatus according to the exemplary embodiment of the present invention.

As shown in the drawings, the sludge suction apparatus according to the present invention includes a housing 210 formed with an exhaust hole 222 for exhausting sludge to the outside and a suction hole 224 for receiving the sludge, a suction valve 230 installed in the housing 210 to communicate with the suction hole 224, an exhaust valve 250 disposed above the suction valve 230 coaxially with the suction valve 230 while communicating with the exhaust hole 222, a valve port 280 for fixing the exhaust valve 250, and a piston assembly 290 for selectively operating the suction valve 230 and the exhaust valve 250 by adjusting internal pressure of the housing 210.

As shown in FIG. 3, the housing 210 is formed with a mounting hole 212 extending from an upper end to a lower end of the housing 210 such that the suction valve 230 and the exhaust valve 250 can be installed in the mounting hole 212. The mounting hole 212 is formed at an inner wall thereof with a screw section so that the valve port 280 can be screw-coupled into the mounting hole 212.

The mounting hole 212 may include an upper mounting hole 214, which is formed at an upper portion of the housing 210 and the exhaust valve 250 is installed in the upper mounting hole 214, and a lower mounting hole 216, which is formed at a lower portion of the housing 210 and the suction valve 230 is installed in the lower mounting hole 214. In addition, a support step 218 is formed at the boundary region between the upper mounting hole 214 and the lower mounting hole 216 to support a lower portion of the exhaust valve 250 as well as the divergent retainer 240 of the suction valve 230.

As mentioned above, the housing 210 is formed with the exhaust hole 222, which is communicated with the upper mounting hole 214 to exhaust the sludge from the exhaust valve 250 to the outside, and the suction hole 224, which is communicated with the lower mounting hole 216 concentrically with the mounting hole 212, so the sludge is introduced into the housing 210 through the suction hole 224 according to the operation of the suction valve 230.

In addition, a coupling section 26 is formed at one side of the lower mounting hole 216. The piston assembly 290 is coupled with the coupling section 226 to selectively operate the suction valve 230 and the exhaust valve 250 by adjusting the internal pressure of the housing 210. The coupling section 226 is formed with an actuating hole 228 communicated with the lower mounting hole 216 to actuate a piston rod 297 of a piston 296.

The suction valve 230 includes a suction seat 232 fixedly inserted into the lower mounting hole 216 of the housing 210, a suction disc 234 that reciprocates up and down according to the operation of the piston assembly 290 and selectively adheres to the suction seat 232 fixedly inserted into the lower mounting hole 216, a suction stem 236 provided above the suction disc 234 to operate the suction disc 234, a suction spring 238 provided at an outer peripheral surface of the suction stem 236 to return the suction disc 234 to its initial position, and the divergent retainer 240 having an upper end fixedly coupled with the support step 218 formed in the housing 210 to support an upper portion of the suction spring 238.

A plurality of sludge inlet holes 242 are formed at an outer peripheral wall of the divergent retainer 240 to guide the sludge toward the exhaust valve 250 and a fixing flange 244 is provided at an upper end of the divergent retainer 240. The fixing flange 244 is fixed to the housing 210 and a lower end of the exhaust valve 250 stably adheres to the fixing flange 244.

If the piston 296 of the piston assembly 290 moves forward, the suction disc 234 of the suction valve 230 moves downward, so that the suction disc 234 adheres to the suction seat 232, thereby stopping the suction operation for the sludge. If the piston 296 of the piston assembly 290 moves rearward, the suction disc 234 of the suction valve 230 moves upward, so that the suction disc 234 is separated from the suction seat 232. Thus, a predetermined gap is formed between the suction disc 234 and the suction seat 233, so that the sludge is introduced through the suction hole 224.

The exhaust valve 250 is provided above the suction valve 230 and fixedly coupled to the fixing flange 244 formed at the upper end of the divergent retainer 240. The exhaust valve 250 includes an exhaust seat 252 fixedly inserted into an exhaust cylinder 270, which is fixedly inserted into the upper mounting hole 214 of the housing 210, an exhaust disc 254 selectively adhering to the exhaust seat 252 while reciprocating up and down according to the operation of the piston assembly 290, an exhaust step 250 provided above the exhaust disc 254 to operate the exhaust disc 254, an exhaust spring 258 provided at an outer peripheral surface of the exhaust stem 256 to return the exhaust disc 254 to its initial position, an exhaust retainer 260 for support an upper portion of the exhaust spring 258, and the exhaust cylinder 270 accommodating the above elements of the exhaust valve 250 therein and being formed with a plurality of sludge drain holes 252.

A fixing member 262 is provided at an upper portion of the exhaust retainer 260. The fixing member 262 is fixedly coupled with the valve port 260 to fix the exhaust valve 250.

That is, the suction seat 232 provided at the lower end of the suction valve 230 is fixedly inserted into the lower mounting hole 216, and the divergent retainer 240 provided at the upper end of the suction valve 230 is fixedly inserted into fixed to the support step 218. The exhaust cylinder 270 of the exhaust valve 250 is fixed while supporting the upper portion of the divergent retainer 240. The fixing member 262 formed at the exhaust retainer 260 of the exhaust valve 250 is fixedly coupled with the valve port 280, so that the exhaust valve 250 is fixed to the housing 210. In particular, since the suction valve 230 is aligned coaxially with the exhaust valve 250, the fixing force of the valve port 280 is transferred in the axial direction of the housing 210, so that the fixing force is transferred to the suction valve 230 as well as the exhaust valve 250, so that the fixing force for the suction valve 230 can be maximized. Similar to the suction valve 230, the exhaust valve 250 moves up and down according to the operation of the piston 296. That is, the exhaust disc 254 of the exhaust valve 250 adheres to the exhaust seat 252 when the piston 296 moves rearward, and the exhaust disc 254 is separated from the exhaust seat 252 when the piston 296 moves forward so that a predetermined gap is formed between the exhaust disc 254 and the exhaust seat 252. The sludge is introduced into the predetermined gap from the suction valve 230 and then exhausted to the outside through the exhaust hole 222.

In other words, the suction valve 230 operates according to the operation of the piston 296, so that the sludge is introduced through the suction hole 224. After that, the sludge is introduced into the exhaust valve 250 through the divergent retainer 240 of the suction valve 230 and then exhausted to the outside through the exhaust hole 222.

The valve port 280 is screw-coupled with the screw section formed at the inner wall of the upper mounting hole 214 of the housing and press-fitted into the upper portion of the exhaust cylinder 270. The valve port 280 is formed with a fixing groove 282 fixedly coupled with the fixing member 262 formed at the exhaust retainer 260 of the exhaust valve 250.

The piston assembly 290 adjusts the internal pressure of the housing 210 to operate the suction valve 230 and the exhaust valve 250. The piston assembly 290 includes a coupling member 292 fixedly coupled to the coupling section 226 provided at one side of the housing 210, a piston housing 295 inserted into a rear portion of the coupling member 292 and receiving an actuating cylinder having the piston 296 and the piston rod 297, and a fixing member 294 provided between the piston housing 295 and the coupling member 292 to reinforce the fixing force.

The coupling member 292 is fixedly fastened to the coupling section 226 of the housing 210 by a fastening unit, such as a bolt. A screw section is formed at an inner wall of the coupling member 292 to fix the fixing member 294.

The fixing member 294 surrounds the outer peripheral surface of the piston housing 295. A screw section is formed at one end of an outer peripheral portion of the fixing member 294 such that the fixing member 294 can be screw-coupled with the coupling member 292. Preferably, the screw section formed in the coupling member 292 may be a female screw section and the screw section formed on the outer peripheral surface of the fixing member 294 may be a male screw section.

In addition, the piston rod 297 installed in the piston housing 295 reciprocates forward and rearward by external power. At this time, the piston 296 provided at the end of the piston rod 297 reciprocates forward and rearward along the actuating hole 228 according to the operation of the piston rod 297, thereby lowering or increasing the internal pressure in the housing 210. The suction valve 230 and the exhaust valve 250 are operated according to variation of the internal pressure in the housing 210.

In other words, if the piston 296 is moved rearward along the actuating hole 228, the volume of the actuating hole 228 of the housing 210, in which the suction valve 230 is installed, is enlarged so that the internal pressure in the housing 210 becomes lower than pressure in the suction hole 224. Thus, the sludge is introduced into the housing 210 through the suction hole 224 and the suction valve 230.

In addition, if the piston 295 moves forward along the actuating hole 228, the internal space of the housing 210 is narrowed, so that the internal pressure of the housing 210 is increased. Thus, the suction spring 238 of the suction valve 230 provided in the lower mounting hole 216 returns to its initial position, so that the suction seat 232 adheres to the suction disc 234, thereby stopping suction of the sludge. In contrast, the exhaust disc 254 of the exhaust valve 250 is separated from the exhaust seat 252 due to the internal pressure of the housing 210 so that the sludge introduced through the suction valve 230 is exhausted through the exhaust hole 22.

Hereinafter, the operation of the sludge suction apparatus according to the present invention will be described in detail.

FIGS. 6*a* to 6*d* are sectional views showing the operational state of the sludge suction apparatus according to the exemplary embodiment of the present invention.

Figure 6A:
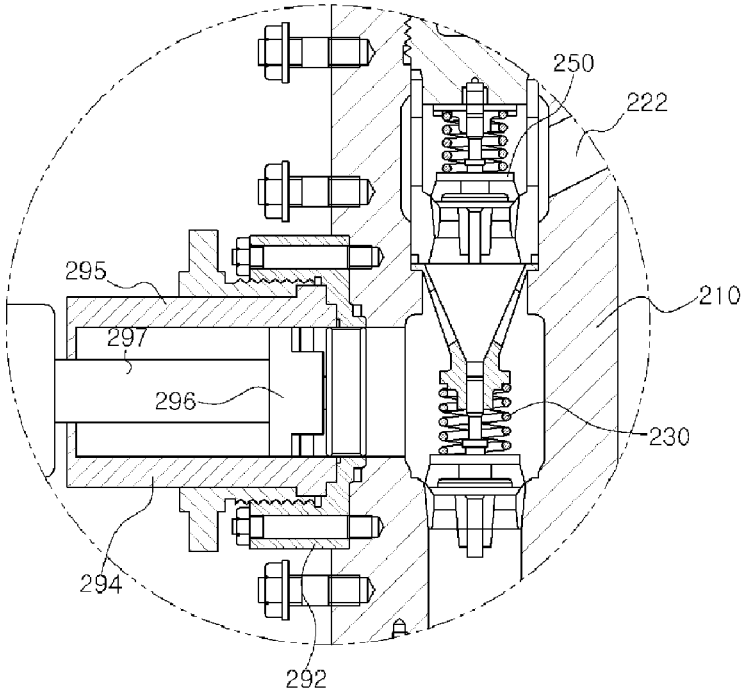
FIGS. 6*a* to 6*d* are sectional views showing the operational state of a sludge suction apparatus according to the exemplary embodiment of the present invention.

As shown in FIG. 6*a*, when the piston 296 of the piston assembly 290 is stopped, the internal pressure of the housing 210 is constantly maintained. That is, the internal area of the housing 210 is constantly maintained so that the suction valve 230 and the exhaust valve 250 may not operate.

Figure 6B:
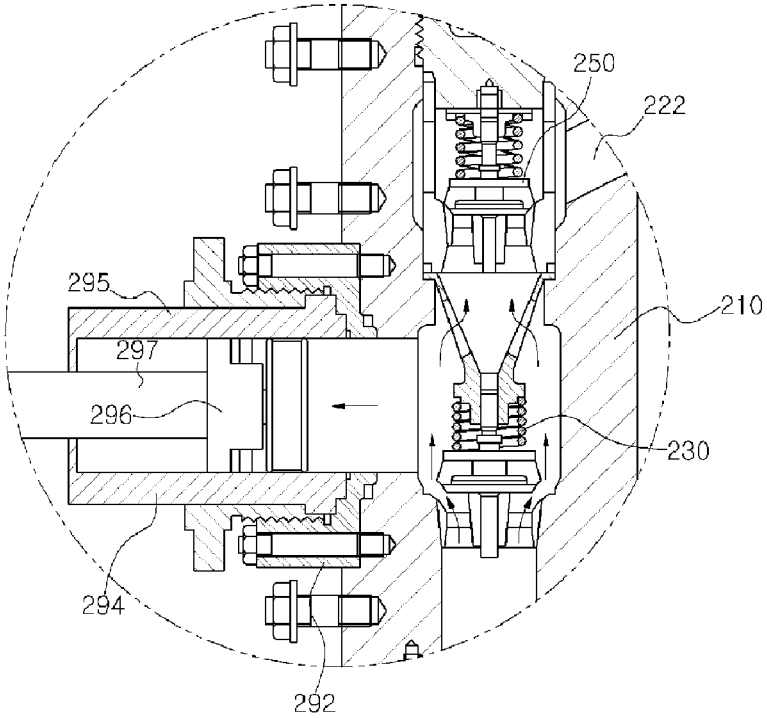

In this state, as shown in FIG. 6*b*, if the piston 296 of the piston assembly 290 moves rearward, the volume of the actuating hole 228 of the housing 210, in which the suction valve 230 is installed, is enlarged so that the suction disc 234 of the suction valve 230 is separated from the suction seat 232.

That is, if the piston 296 moves rearward, the internal pressure of the housing 210 is lowered than the pressure in the suction hole 224, so that the suction force is generated. Accordingly, the sludge is introduced into the housing 210 through the suction hole 224.

In contrast, the exhaust seat 252 of the exhaust valve 250 adheres to the exhaust disc 254.

Figure 6C:
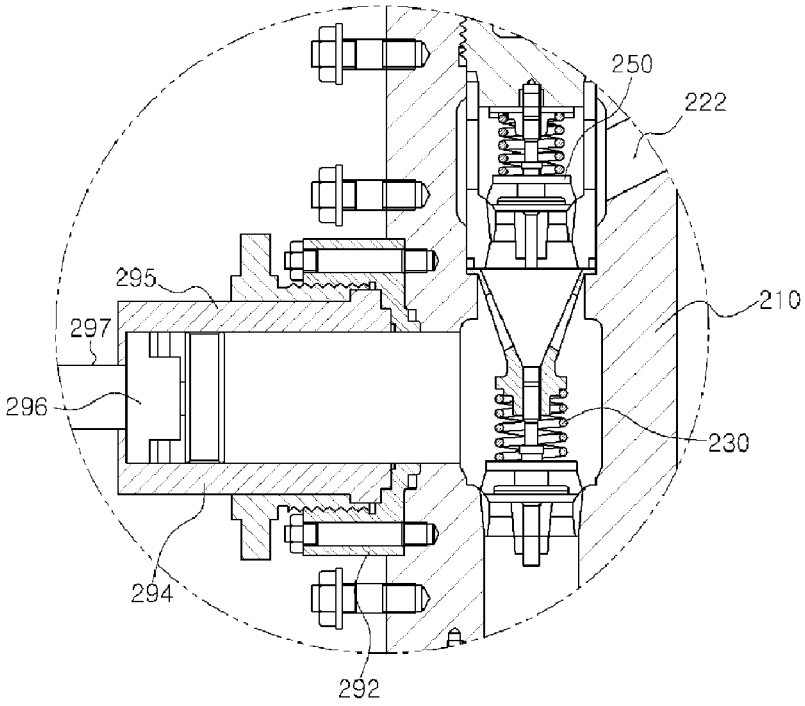

In addition, as shown in FIG. 6*c*, if the piston 296 stops the movement in the rearward direction, the suction seat 232 adheres again to the suction disc 234 due to elastic force of the compressed suction spring 238 so that the sludge is not introduced through the suction hole 224.

Figure 6D:
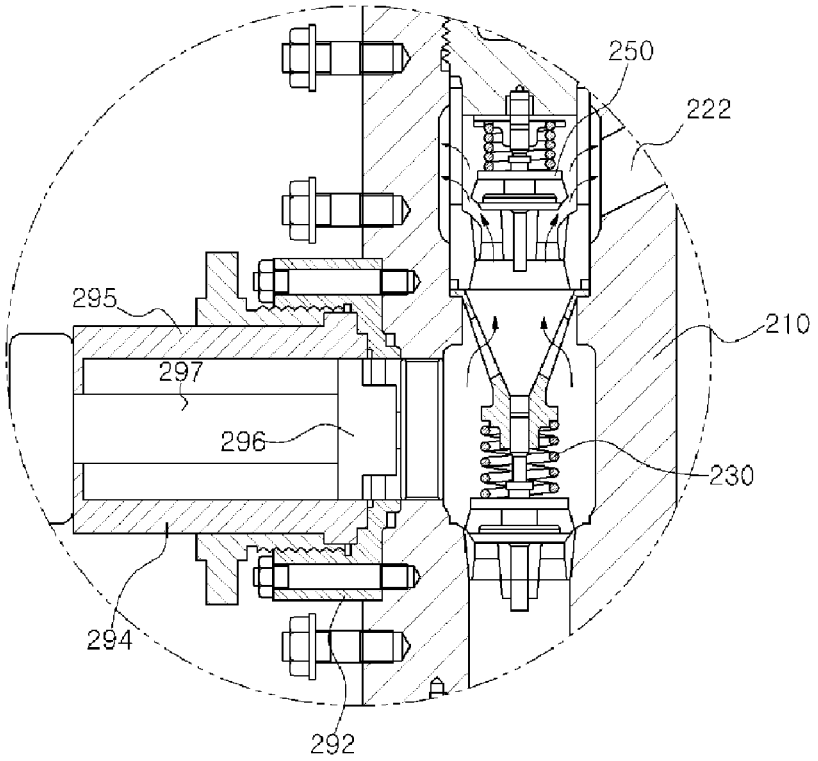

Then, as shown in FIG. 6*d*, if the piston 296 of the piston assembly 290 moves forward, the exhaust spring 258 is compressed due to the internal pressure of the housing 210. At this time, the exhaust seat 252 of the exhaust valve 250 is completely separated from the exhaust disc 254 so that the sludge introduced during the operation of the suction valve 230 is exhausted to the outside through the exhaust hole 222 formed in the housing 210.

That is, as the piston 296 moves forward, the internal pressure of the housing 210 is increased so that the suction valve 230 is closed and the exhaust valve 250 is open. At the same time, the sludge is moved upward so that the sludge is exhausted to the outside through the exhaust hole 222 formed in the housing 210.

As described above, the sludge suction apparatus according to the present invention has no fixing unit for installing and fixing the suction valve 230, so that the manufacturing cost thereof can be reduced, and the sludge suction apparatus is easily assembled and disassembled so that stability and workability can be improved. In addition, the suction valve 230 provided at an upper end thereof with the divergent retainer 240 is installed in the mounting hole 212, in which the exhaust valve 250 is installed, coaxially with the exhaust valve 250, so that the sludge suction apparatus can be easily assembled and disassembled, thereby reducing the cost for the maintenance and repair work. Further, pressure variation can be maximized when the piston 296 operates, thereby stably sucking and exhausting the sludge while improving feeding force for the sludge.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A sludge suction apparatus for an offshore structure, the sludge suction apparatus comprising:

a housing having an upper mounting hole communicated with an exhaust hole for exhausting sludge and a lower mounting hole communicated with a suction hole for sucking the sludge, and including a coupling section formed at one side thereof with an actuating hole communicated with the lower mounting hole;

a suction valve installed in the lower mounting hole in line with the suction hole to selectively suck the sludge according to variation of internal pressure of the housing;

an exhaust valve installed in the upper mounting hole to communicate with the exhaust hole and aligned coaxially with the suction valve to exhaust the sludge, which is sucked through the suction valve according to the variation of the internal pressure of the housing, to an outside through the exhaust hole;

a valve port coupled to an upper portion of the upper mounting hole and formed with a fixing groove coupled with an upper portion of the exhaust valve to fix the exhaust valve; and a piston assembly fixedly coupled with the coupling section and reciprocated in forward and rearward directions to operate the suction valve and the exhaust valve by changing the internal pressure of the housing, wherein a support step is formed between the upper mounting hole and the lower mounting hole of the housing to support the suction valve and the exhaust valve, wherein the suction valve comprises:

a suction seat fixedly inserted into the lower mounting hole of the housing;

a suction disc provided at an upper end thereof with a suction stem and selectively adhering to or separated from the suction seat by performing reciprocating motion in upward and downward directions according to operation of the piston assembly;

a suction spring provided at an upper portion of the suction disc to return the suction disc to an initial position thereof; and a divergent retainer having an upper end fixed to the housing to support the suction spring and formed at an outer peripheral surface thereof with a sludge inlet hole to guide the sludge to the exhaust valve, and wherein the divergent retainer is provided at an upper end thereof with a fixing flange, wherein the fixing flange fixes the suction valve to the housing, and wherein a lower end of the exhaust valve is stably rested on the fixing flange.

2. The sludge suction apparatus of claim 1, wherein the exhaust valve comprises:

an exhaust seat fixedly inserted into the upper mounting hole of the housing;

an exhaust disc provided at an upper end thereof with an exhaust stem and selectively adhering to or separated from the exhaust seat by performing reciprocating motion in upward and downward directions according to operation of the piston assembly;

an exhaust spring provided at an upper portion of the exhaust disc to return the exhaust disc to an initial position thereof;

an exhaust retainer supporting an upper portion of the exhaust spring and provided at an upper end thereof with a fixing section coupled with the valve port to fix the exhaust valve; and an exhaust cylinder receiving the above elements of the exhaust valve and formed with a sludge drain hole to drain the sludge to the exhaust hole.

3. The sludge suction apparatus of claim 1, wherein the piston assembly comprises:

a coupling member fixedly coupled with the coupling section of the housing;

a piston housing inserted into a rear portion of the coupling member;

a fixing member for fixing the piston housing to the coupling member; and an actuating cylinder installed in the piston housing and positioned in the actuating hole of the housing, the actuating cylinder including a piston and a piston rod that perform reciprocating motion in forward and rearward directions.

* * * * *